US007541901B2

(12) United States Patent
Nakano et al.

(10) Patent No.: US 7,541,901 B2
(45) Date of Patent: Jun. 2, 2009

(54) CIRCUIT BREAKER

(75) Inventors: Masaaki Nakano, Saitama (JP); Syuichi Sugiyama, Chiba (JP); Masaru Isozaki, Chiba (JP)

(73) Assignee: Fuji Electric FA Components & Systems Co., Ltd., Tokyo (JP)

( * ) Notice: Subject to any disclaimer, the term of this patent is extended or adjusted under 35 U.S.C. 154(b) by 110 days.

(21) Appl. No.: 11/712,899

(22) Filed: Mar. 2, 2007

(65) Prior Publication Data

US 2007/0210885 A1 Sep. 13, 2007

(30) Foreign Application Priority Data

Mar. 13, 2006 (JP) ..... 2006-067518
Nov. 27, 2006 (JP) ..... 2006-318028

(51) Int. Cl.
*H01H 9/30* (2006.01)

(52) U.S. Cl. ..... 335/201

(58) Field of Classification Search ..... 335/201
See application file for complete search history.

(56) References Cited

U.S. PATENT DOCUMENTS 4,484,045 A * 11/1984 Seymour et al. ..... 218/149
4,521,653 A * 6/1985 Yoshiyasu et al. ..... 218/150
4,743,720 A * 5/1988 Takeuchi et al. ..... 218/24
4,778,958 A * 10/1988 Mayer et al. ..... 218/146
5,223,681 A * 6/1993 Buehler et al. ..... 218/22
6,075,429 A * 6/2000 Uotome et al. ..... 335/78
6,222,147 B1 * 4/2001 Doughty et al. ..... 218/157
6,242,707 B1 * 6/2001 Mody et al. ..... 218/1
6,373,016 B2 * 4/2002 Brouillat et al. ..... 218/154

* cited by examiner

*Primary Examiner*—Lincoln Donovan
*Assistant Examiner*—Alexander Talpalatskiy
(74) *Attorney, Agent, or Firm*—Manabu Kanesaka

(57) ABSTRACT

A circuit breaker for a double-break mechanism includes a current interrupting section having a contact mechanism. The contact mechanism includes first and second fixed contactors arranged in parallel and having fixed contacts, and a bridging movable contactor having an arm with movable contacts opposing the fixed contacts. A magnetic plate may be interposed in a middle region between two pairs of the fixed and movable contacts extending along a path of switching movement of the movable contactor. Partition walls formed of organic polymer material may be provided to stand along the path of the movable contactor. The partition walls sandwich each pair of the fixed contact and the movable contact to form a narrow gap arc extinguishing space between the partition walls.

3 Claims, 6 Drawing Sheets

CIRCUIT BREAKER

BACKGROUND OF THE INVENTION AND RELATED ART STATEMENT

The present invention relates to circuit breakers including molded case circuit breakers and earth leakage breakers, in particular to structures of current interrupting sections in the circuit breakers.

This type of circuit breakers as mentioned above is a double-break type circuit breaker that comprises first and second fixed contactors of a current interrupting section in parallel arrangement, a bridge type rotatably movable contactor that holds movable contacts on the ends of a U-shaped arm, opposing fixed contacts attached on the ends of the fixed contactors, and a grid type arc extinguishing device which is disposed opposing and in front of the movable contactor (for example Japanese Patent Publication (Kokai) No. 11-273536).

FIG. 8 and FIG. 9 show a conventional structure of the double-break type circuit breaker and its current interrupting section. Referring to FIG. 8, the circuit breaker comprises a main body casing 10 of the circuit breaker, a handle 11 for switching operation, a switching mechanism 12, and a current interrupting section 13. As described afterwards, the current interrupting section 13 is composed of a pair of fixed contactors arranged in parallel and connected to the line side and the load side terminals, a bridge type movable contactor opposing these fixed contactors and linking to the switching mechanism, and an arc extinguishing device.

FIG. 9 shows a detailed structure of the current interrupting section, wherein the reference numeral 1 designates a first fixed contactor extending to the line side terminal; 2 is a second fixed contactor extending to the load side terminal; 1*a* and 2*a* are fixed contacts attached on the ends of the fixed contactors 1 and 2; numeral 3 is a rotatably movable bridge type contactor having movable contacts 3*a* and 3*b* opposing the fixed contacts 1*a* and 2*a* and attached on the ends of a U-shaped arm; 4 is an arc extinguishing device disposed in front of the movable contactor 3 and along the path of switching movement of the movable contactor 3; 4*a* shows grids (magnetic plates) arranged vertically between side walls of the arc extinguishing device 4; and numeral 5 is a rotating shaft of the movable contactor 3, the movable contactor 3 linking to the switching mechanism 12 (FIG. 8) through a contactor holder.

When the movable contactor 3 in this structure is opened, as shown in FIG. 10 in the event of current interruption, as is well known, arc "arc" develops between the fixed contacts 1*a*, 2*a* of the first and second fixed contactors 1, 2 and the movable contacts 3*a*, 3*b* of the movable contactor 3. The arc extends from I to II in FIG. 10 by an electromagnetic driving force and is divided by the grids 4*a* of the arc extinguishing device 4 to raise the arc voltage and receive a cooling effect. Thus, the arc is extinguished and the electric current is limited and interrupted.

The current interrupting section of double-break type as described above, however, has a problem in that abnormal dissipation of the fixed and movable contacts occurs with repeated current interruption as described below, causing poor contact performance between the fixed and movable contacts in a closed state. A mechanism in the abnormal dissipation of contacts will be described in FIGS. 11(*a*)-11(*c*).

The current interrupting section of double-break type as shown in FIG. 9 generates arc 1 and arc 2 between the fixed contacts 1*a*, 2*a* and the movable contacts 3*a*, 3*b* in which electric currents i of the arcs are in reversed directions with each other as shown in FIG. 11(*a*). As a result, a repulsive electromagnetic force F acts on the arc 1 generated between the fixed contact 1*a* and the movable contact 3*a* and the arc 2 generated between the fixed contact 2*a* and the movable contact 3*b* to force the arcs to separate each other. Therefore, beginning points of the arcs on the fixed and movable contacts move from the center of the contact surface outwardly in the opposite directions due to the repulsive electromagnetic force F as shown in FIG. 11(*b*).

Interruption of a heavy short circuit current in the current interruption section generally causes dissipation of the movable contacts 3*a* and 3*b* due to melting and evaporation in the surface region of the contacts by energy of the arc. When the beginning points of the arc 1 and arc 2 move away on the contact surface outwardly as shown in FIG. 11(*b*), dissipation of the contacts is concentrated at the end regions as shown in FIG. 11(*c*). This unbalanced dissipation causes poor contact performance (decrease of contact area) between the fixed and movable contacts in the closed state of the contactor mechanism, which in turn leads to troubles such as extraordinary heating and adhesion of the contacts in the current flowing condition.

Therefore, an object of the present invention is to provide an improved circuit breaker of a double-break type that suppresses the abnormal dissipation of contacts as shown in FIG. 11(*c*) to achieve a long life, avoid the poor contact performance between contacts in a closed state, and improve arc extinguishing capability.

Further objects and advantages of the invention will be apparent from the following description of the invention.

SUMMARY OF THE INVENTION

To attain the above objects, a circuit breaker of a double-break type according to the present invention comprises, in a contact mechanism of a current interrupting section of the circuit breaker, first and second fixed contactors arranged in parallel and a bridge type movable contactor that holds, on the ends of a U-shaped arm, movable contacts opposing fixed contacts attached on the ends of the fixed contactors, wherein a circuit breaker according to the first invention comprises a magnetic plate interposed in a middle region between two pairs of the fixed and movable contacts at both sides and extending along the path of a switching movement of the movable contactor (first aspect).

A circuit breaker of the second aspect of the present invention comprises partition walls of organic polymer material provided to stand along a path of the switching movement of the movable contactor, the partition walls sandwiching each pair of the fixed contact and the movable contact at both sides thereof, to form a narrow gap arc extinguishing space between the partition walls. The partition walls have the following variations as to constitution.

(1) Among the partition walls (of organic polymer material) that sandwich the pair of fixed and movable contacts at both sides thereof, the partition walls provided outside the pairs of fixed and movable contacts are composed of an organic polymer material that generates a greater amount of evaporating gas due to the heat of arcing and the partition wall provided inside the pairs of fixed and movable contacts is composed of an organic polymer material that generates a smaller amount of evaporating gas (third aspect).

(2) Among the partition walls (of organic polymer material) that sandwich the pair of fixed and movable contacts at both sides thereof, the partition walls provided outside the pairs of fixed and movable contacts are thicker than the partition wall provided inside the pairs of fixed and movable contacts (forth aspect).

(3) Among the partition walls (of organic polymer material) that sandwich the pair of fixed and movable contacts at both sides thereof, a distance between the pair of the fixed and movable contacts and the partition wall provided outside the pair of fixed and movable contacts is smaller than a distance between the pair of fixed and movable contacts and the partition wall provided inside the pair of fixed and movable contacts (fifth aspect).

A circuit breaker comprising a current interrupting section as described above has the following effects. In a circuit breaker according to the first aspect, which comprises the magnetic plate interposed in a middle region between the two pairs of fixed and movable contacts at both sides and extending along a path of the switching movement of the movable contactor, the magnetic plate performs a function of a magnetic shield inhibiting interference between the magnetic fields of arcs generated between the pairs of the fixed and movable contactors. As a result, the repulsive electromagnetic force F separating the arcs as shown in FIG. 11(*b*) is eliminated. The beginning points of the arcs are prevented from moving aside on the surface of the contact, and the abnormal dissipation of the contacts due to this movement is suppressed. Therefore, the poor contact performance between the contacts is effectively avoided in the closed state of the contacts.

In a circuit breaker of the second aspect, the partition walls of organic polymer material are provided to sandwich each pair of the fixed and movable contacts at both sides thereof to function as narrow gap arc extinguishing plates and create a narrow gap arc extinguishing space between the partition walls. When the arcs develop between the fixed and movable contacts in the event of current interruption and extend towards the partition walls provided outside the arcs driven by the repulsive electromagnetic force F (FIG. 11(*b*)), the organic material of the partition walls is decomposed by the heat of the arc, bursting a gas flow from the surface of the partition walls to the arcs. The arcs are pushed back by the gas flow, resulting in the beginning points of the arcs to stay at the central position of the contacts. Thus, the deflecting movement is suppressed as shown in FIG. 11 (*c*).

An arc extinguishing effect is additionally produced by a narrow gap current limiting effect that is brought about owing to the structure of the second aspect in which the partition walls of organic polymer material are provided sandwiching each pair of the fixed and movable contacts at both sides thereof to function as the narrow gap arc extinguishing plates and create a narrow gap arc extinguishing space between the partition walls. By combining these partition walls with a grid type arc extinguishing device and disposing in a current interrupting section, the arc extinguishing capability of a circuit breaker is greatly improved.

In the structure according to another aspect of the invention, the partition walls provided outside the pairs of fixed and movable contacts are composed of an organic polymer material that generates a greater amount of evaporating gas due to the heat of arcing and the partition wall provided inside the pairs of fixed and movable contacts is composed of an organic polymer material that generates a smaller amount of evaporating gas. This structure makes it possible that the repulsive electromagnetic force F acting on the arc between the fixed contact and the movable contact (FIG. 11(*b*)) is cancelled by the bursting gas flow from the outer partition wall towards the narrow gap arc extinguishing space, the gas flow from the outer partition walls being stronger owing to the difference in the amount of evaporating gas from the outer and inner partition walls. As a result, the arc is pushed back to the central region of the contact surface, so that the abnormal dissipation of the contact is effectively suppressed.

In the structure according to yet another aspect of the invention, the partition walls provided outside the pairs of fixed and movable contacts are thicker than the partition wall(s) provided inside the pairs of fixed and movable contacts. This structure allows the outer partition walls that evaporate larger amount of gas to prevent from early dissipation and loss of strength for an arc extinguishing plate. It also allows the partition walls to keep the narrow gap current limiting effect stable for a long time.

In the structure according to still another aspect of the invention, a distance between the pair of fixed and movable contacts and the partition wall provided outside the pair of fixed and movable contacts is smaller than a distance between the pair of fixed and movable contacts and the partition wall provided inside the pair of fixed and movable contacts. Due to this structure, the amount of gas, generated out of the partition wall and caused by exposure to the arc between the fixed contact and the movable contact in the event of current interruption, is larger in the evaporation from the outer partition wall that is nearer to the contacts than the evaporation from the inner partition wall. As a result, the gas flow that pushes the arc from outside to inside is dominant in the narrow gap arc extinguishing space. On the contrary, the electromagnetic force F (FIG. 11(*b*)) that urges to separate the arcs between the pairs of fixed and movable contacts is inversely proportional to the distance between the arcs.

The synergy effect allows the pushing back force of the gas to the arc and the repulsive electromagnetic force to separate the arcs each other to be canceled each other. Therefore, the abnormal dissipation (unbalanced dissipation) of the contacts caused by outward shift of the beginning point of the arc, is more effectively suppressed.

DETAILED DESCRIPTION OF THE EMBODIMENTS

Figure 9:
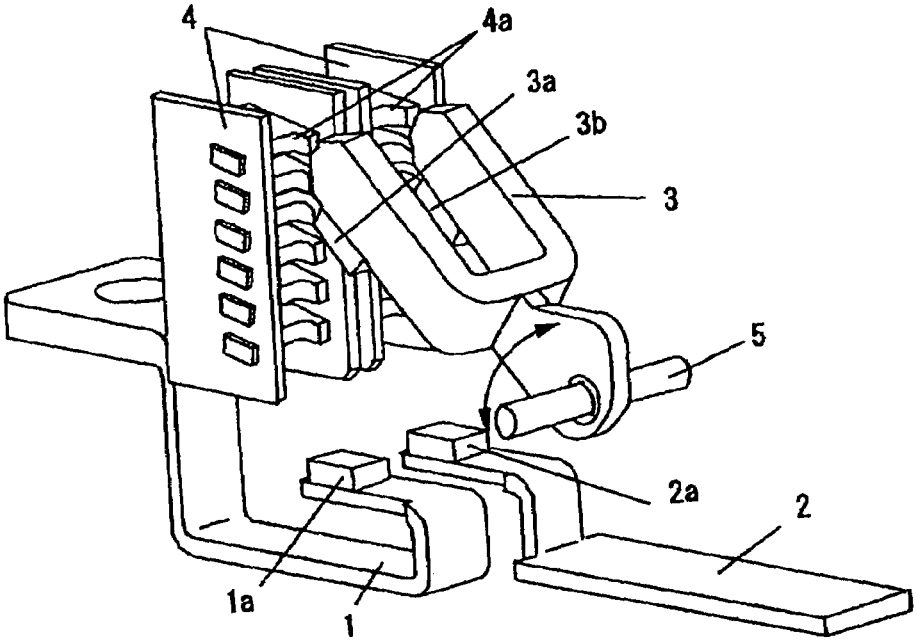
Fig. 9 Prior Art
FIG. 9 is a perspective view showing a prior art structure of a current interrupting section of FIG. 8.
Figure 10:
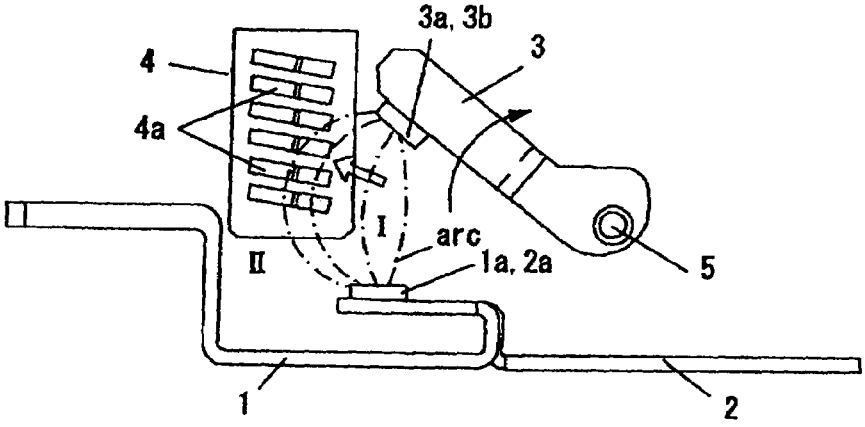
Fig. 10 Prior Art
FIG. 10 shows movements of an arc generated between the fixed and movable contacts upon opening operation in the current interrupting section of FIG. 9.

Some preferred embodiments according to the invention will be described with reference to the accompanying drawings. In the drawings of embodiments, the parts corresponding to those in FIG. 9 are given the same symbols and description on the parts is omitted.

EXAMPLE 1

Figure 1:
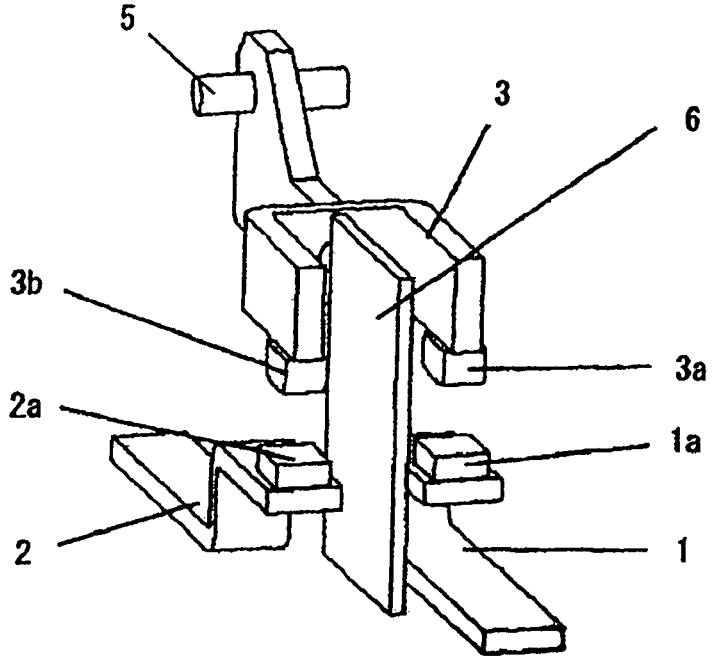
FIG. 1 is a perspective view of a contact mechanism of a current interrupting section in Example 1 according to the invention.
Figure 2:
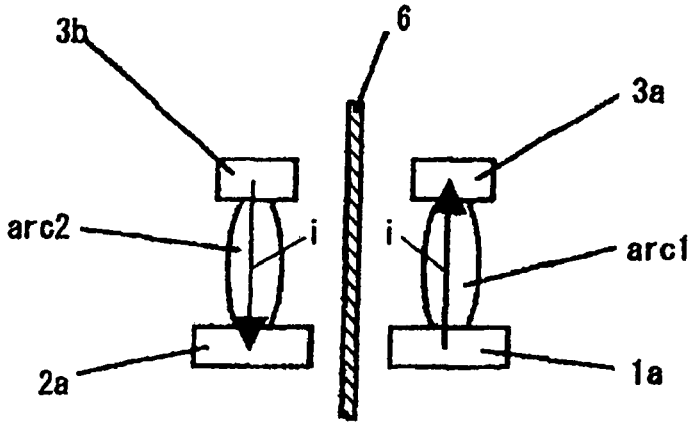
FIG. 2 shows movements of the arcs generated between fixed and movable contacts in the event of current interruption in the structure of FIG. 1.

Now, description will be first made on the structure and function of the invention referring to FIG. 1 and FIG. 2. The contact mechanism of the example shown in these figures is basically similar to the conventional structure shown in FIG. 9. However, a magnetic plate 6 extending vertically is newly provided as shown in FIGS. 1 and 2. The magnetic plate 6 is interposed in a middle region between the fixed contacts 1*a* and 2*a* of the first and the second contactors 1 and 2 at both sides and extending along a path of switching movement of the movable contactor 3. A sufficient distance is secured from the magnetic plate 6 to the fixed contactors 1, 2 and the movable contactor 3 so as to inhibit contact between the magnetic plate and the arc generated in the event of current interruption, thereby avoiding short circuit between the fixed contactors 1 and 2 through a current path of the magnetic plate 6.

In this structure as shown in FIG. 2, the magnetic plate 6 functions as a magnetic shield for the arc 1 generated between the fixed contact 1*a* of the fixed contactor 1 and the movable contact 3*a* of the movable contactor 3, and for the arc 2 generated between the fixed contact 2*a* of the fixed contactor 2 and the movable contact 3*b* of the movable contactor 3. The magnetic plate 6 magnetically shields the repulsive electromagnetic force F as shown in FIG. 11(*b*) acting between the arc 1 and the arc 2.

Figure 11A:
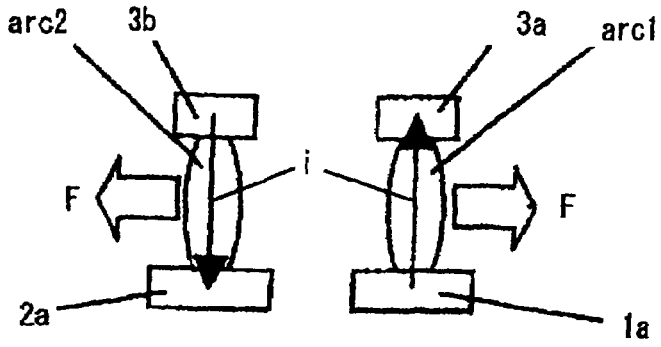
FIGS. 11(*a*) to 11(*c*) schematically show movements of the arc generated between the fixed and movable contacts in FIG. 10, in which FIG. 11(*a*) shows a state immediately after the beginning of opening operation, FIG. 11(*b*) shows a state after the arcs moved away from each other due to a repulsive electromagnetic force between the arcs, and FIG. 11(*c*) shows the fixed and movable contacts with a configuration of unbalanced dissipation.
Figure 11B:
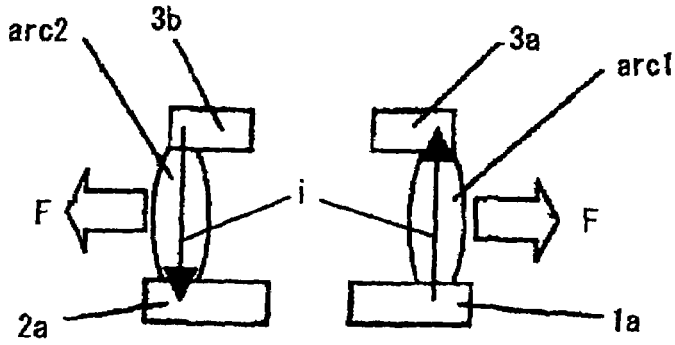
Figure 11C:
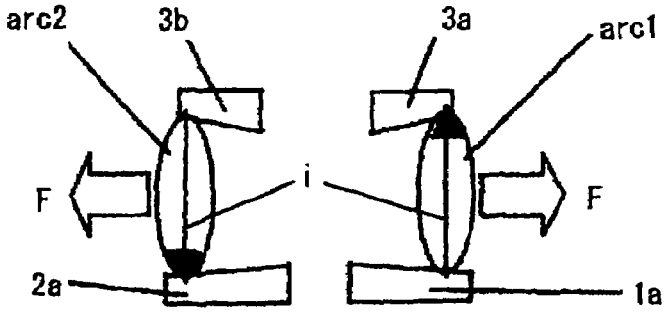

As a result, the beginning point of the arc generated between the fixed and movable contacts stays at the center of the contact surface as shown in FIG. 2, and does not moves away towards the end region of the contact as shown in FIG. 11(*b*). Therefore, the abnormal dissipation of the contacts (FIG. 11(*c*)) is suppressed and the poor contact performance between the fixed and movable contacts is effectively avoided in the closed state.

EXAMPLE 2

Next, description will be made on the structure and function of the invention referring to FIG. 3 and FIG. 4. In this example, a narrow gap partition wall assembly 7 is provided by molding a matrix resin of an organic polymer material, the assembly comprising three sheets of partition walls 7*a*, 7*b*, 7*c* and a bottom wall 7*d* in a configuration of letter "E". The three sheets of the partition walls are arranged sandwiching the first and second fixed contactors 1, 2 and the U-shaped arm of the bridge type movable contactor 3 along the switching path of the movable contactor 3, forming narrow gap arc extinguishing spaces for the pairs of fixed and movable contacts between the partition walls 7*a* and 7*c*, and between the partition walls 7*b* and 7*c*.

When the arc 1 developed between the fixed contact 1*a* and the movable contact 3*a*, and the arc 2 developed between the fixed contact 2*a* and the movable contact 3*b* in the event of current interruption move away in the opposite directions by the repulsive electromagnetic force (FIG. 11(*b*)) acting between the arcs, the arcs approach the partition walls 7*a* and 7*b* of the organic polymer material provided outside the arcs, and the partition walls become exposed directly to the arcs. As a result, the surfaces of the partition walls 7*a* and 7*b* are decomposed by the heat of the arcs evaporating a gas. Thus, the bursting gas flows, i.e. gas 1 and gas 2, are produced directing towards the arc 1 and arc 2 from the surfaces of the partition walls 7*a* and 7*b* as shown by the arrows in FIG. 4, As a result, the arc 1 and arc 2 are pushed back to the centers of the contact surfaces against the repulsive electromagnetic forces between the arcs. Therefore, the abnormal or unbalanced dissipation is prevented in the fixed contacts 1*a*, 2*a* and the movable contacts 3*a*, 3*b* likewise in Example 1.

Figure 3:
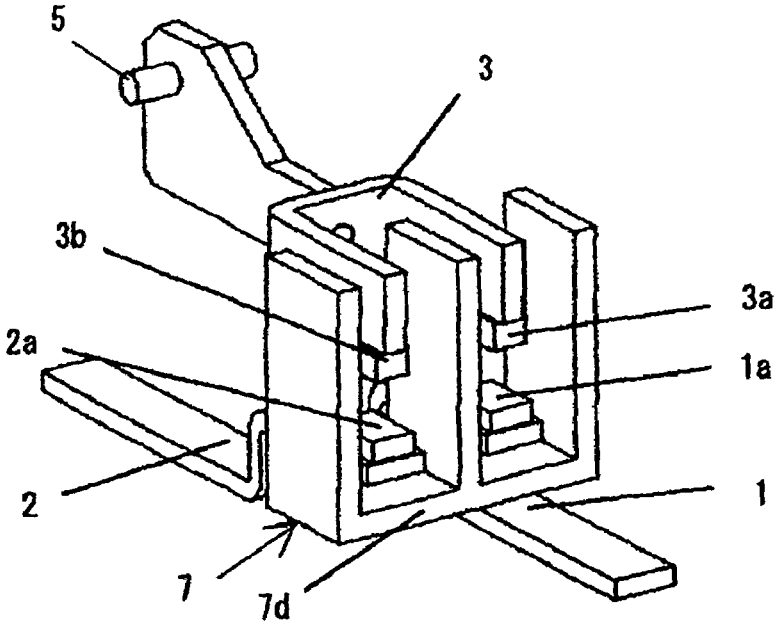
FIG. 3 is a perspective view of a current interrupting section in Example 2 according to the invention.
Figure 4:
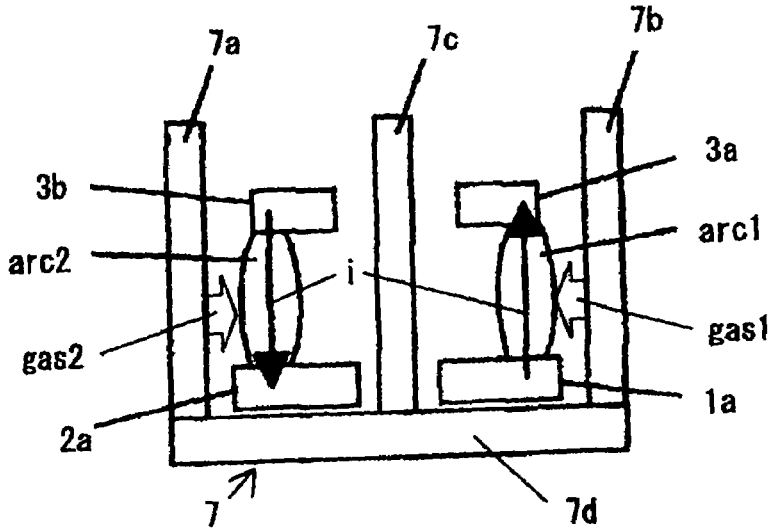
FIG. 4 shows movements of the arcs generated between the fixed and movable contacts in the event of current interruption and illustrates a function of the narrow gap partition wall assembly of FIG. 3.

In the structure of this Example 2, a narrow gap arc extinguishing space is created around each pair of fixed and movable contacts by arranging three sheets of partition walls 7*a*, 7*b*, and 7*c* sandwiching each pair of fixed and movable contacts and standing at the center as shown in FIGS. 3 and 4. This structure produces a narrow gap effect on the arcs by virtue of the evaporated gas from the partition walls in the event of current interruption. Therefore, in a combined construction of the narrow gap partition wall assembly 7 and a grid type arc extinguishing device 4 as shown in FIG. 9, the arcs are quickly extinguished, improving the arc extinguishing capability of the circuit breaker.

EXAMPLE 3

Figure 5:
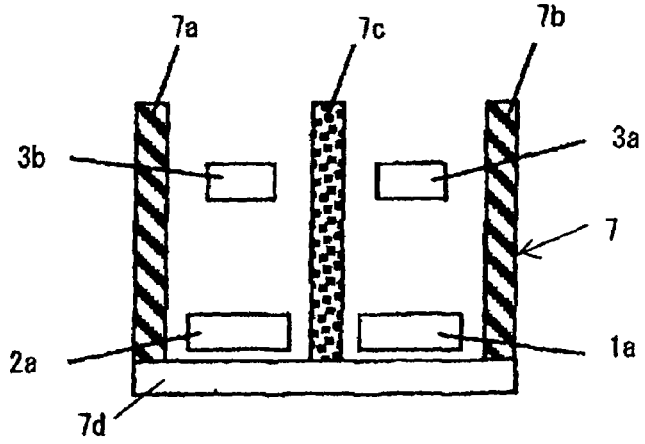
FIGS. 5(*a*) and 5(*b*) illustrate a structure and a function of the essential parts of the current interrupting section in Example 3 according to the invention, in which FIG. 5(*a*) is a sectional view of the narrow gap partition wall assembly and FIG. 5(*b*) shows movements of the arcs generated between the fixed and movable contacts in the event of current interruption.
Figure 5:
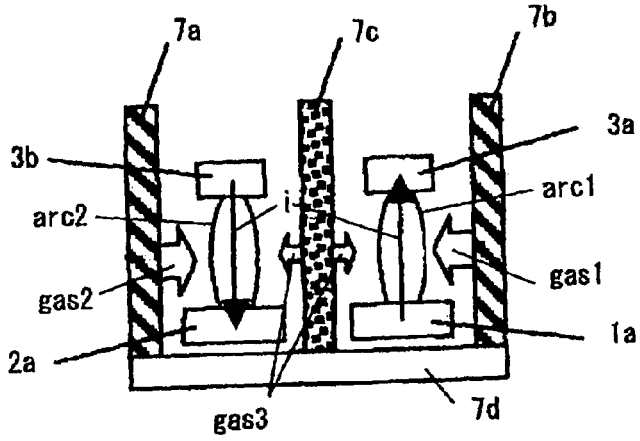

FIGS. 5(*a*) and 5(*b*) show Example 3 that is further improved from Example 2 of the invention. Among the partition walls 7*a*, 7*b*, 7*c* composing the narrow gap partition wall assembly 7 and arranged at both sides and at a center in this Example 3, material of the partition walls 7*a* and 7*b* arranged at the both sides is an organic polymer material that is readily decomposed by the heat of arc and evaporates a large amount of gases, while the material of the partition wall 7*c* arranged at the center is an organic polymer material that evaporates a smaller amount of gases. These materials are used in the partition walls to form narrow gap arc extinguishing spaces between the partition walls. The organic polymer material evaporating a large amount of gases can be selected from polyacetal, poly(methyl methacrylate), and the like; and the organic polymer material evaporating a small amount of gases can be selected from polyamide, polyethylene, poly (fluoroethylene), and the like.

When the partition walls 7*a*, 7*b*, 7*c* are exposed to the arcs arc 1 and arc 2 developed between the fixed contacts 1*a*, 2*a* and the movable contacts 3*a*, 3*b* in the above-described structure as shown in FIG. 5(*b*), the amount of the gas evaporating from the surfaces of the partition walls is, because of the difference in material property, larger in the gas 1 and gas 2 evaporating from the partition walls 7*a* and 7*b* located outside, than in the gas 3 evaporating from the partition wall 7*c* located inside. As a result, the arc 1 and the arc 2 developed between each pair of the fixed and movable contacts are pushed back towards inside by the evaporated gas flow, i.e.

gas 1 and gas 2, emitting from the partition walls 7*a* and 7*b* at the both sides, canceling the repulsive electromagnetic force F (FIG. 11(*b*)).

Thus, the beginning point of the arc is prevented from moving away towards the end of the contact surface and stays in the center of the contact surface as shown in the figure. Therefore, the abnormal or unbalanced dissipation of the contact is avoided, and with the additional arc extinguishing effect by the narrow gap arc extinguishing space formed between the partition walls, high circuit breaking performance is achieved.

EXAMPLE 4

Figure 6:
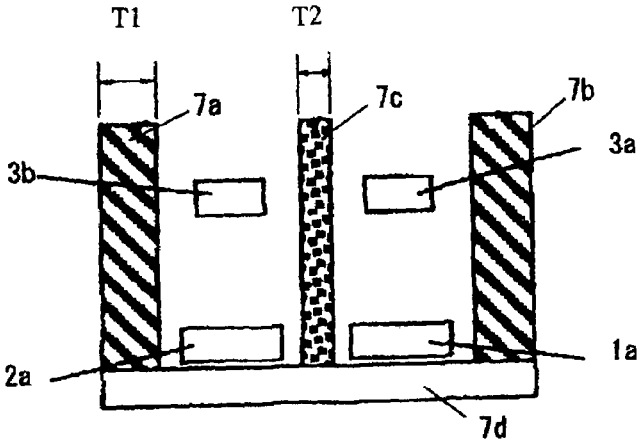
FIG. 6 is a perspective view of a current interrupting section in Example 4 according to the invention.

FIG. 6 shows Example 4 of the invention. In the structure of Examples 2 and 3, the partition walls dissipate and become thin earlier in the partition walls 7*a* and 7*b* standing outside the two pairs of fixed and movable contacts than in the partition wall 7*c* disposed inside the contact pairs, due to the heat of arcs in the event of current interruption. Consequently, the outer partition walls 7*a* and 7*b*, as they are, dissipate earlier than the inner partition wall 7*c*, degrading function and strength as a narrow gap partition wall.

Accordingly, the thicknesses t1 of the partition walls 7*a* and 7*b* disposed outside the pairs of fixed and movable contacts are made thicker than the thickness t2 of the inner partition wall 7*c* disposed in the middle position (t1>t2), thereby preventing the partition walls 7*a* and 7*b* that dissipate faster due to a larger amount of evaporating gas from lowering of strength. Therefore, the narrow gap current limiting effect in the event of current interruption is stably kept for a long time.

EXAMPLE 5

Figure 7:
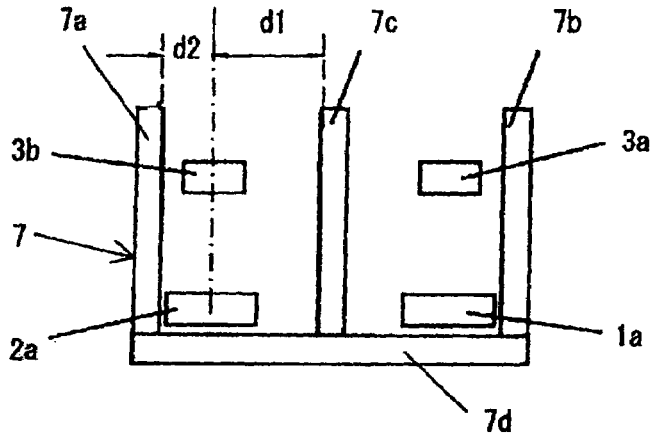
FIGS. 7(*a*) and 7(*b*) illustrate a structure and a function of the essential parts of the current interrupting section in Example 5 according to the invention, in which FIG. 7(*a*) is a sectional view of the narrow gap partition wall assembly and FIG. 7(*b*) shows movements of the arcs generated between the fixed and movable contacts in the event of current interruption.
Figure 7:
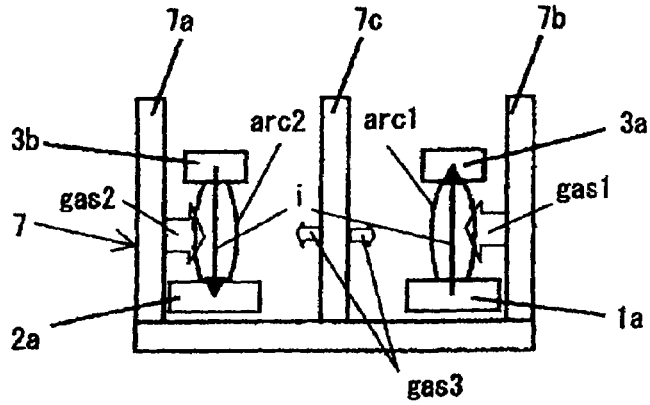
Figure 8:
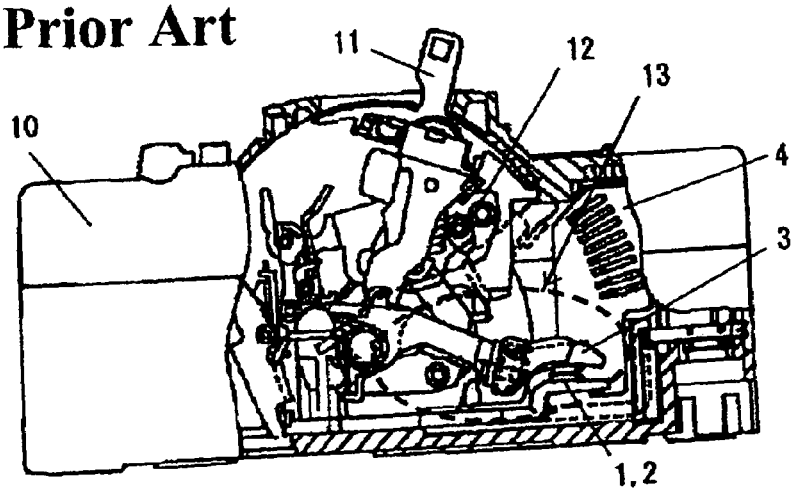
Fig. 8 Prior Art
FIG. 8 is a side sectional view of a double-break type circuit breaker.

Next, the structure and function of Example 5 of the invention is described referring to FIGS. 7(*a*) and 7(*b*). In Example 5, the positions of the partition walls 7*a*, 7*b*, 7*c* of the narrow gap partition wall assembly are shifted relative to the contact mechanism formed of the first and second fixed contactors 1,2 and the bridge type movable contactor 3 as shown in FIGS. 7(*a*) and 7(*b*).

Regarding the three sheets of partition walls (made of an organic polymer material) 7*a*, 7*b*, 7*c* provided sandwiching the pair of fixed contact 1*a* and movable contact 3*a* and the pair of fixed contact 2*a* and movable contact 3*b*, and provided between the pairs of contacts, the distance d2 is shorter than the distance d1 (d2<d1), where d1 is the distance between the partition wall 7*c* in the middle (inside) and the pair of a fixed contact and a movable contact, and d2 is the distance between the partition wall 7*a* or 7*b* at both sides (outside) and the pair of a fixed contact and a movable contact (FIG. 7(*a*)).

Regarding the gas 1, gas 2, gas 3 evaporating from the surface of the partition walls 7*a*, 7*b*, 7*c* exposed to the arc 1 and arc 2 developed between the fixed and movable contacts in the event of current interruption in this structure, the amount of the gas 1 and gas 2 evaporating from the outer partition walls 7*a*, 7*b*, which are located at a shorter distance to the pair of fixed and movable contacts, is larger than the amount of gas 3 evaporating from the partition wall 7*c* disposed inside (FIG. 7(*b*)).

In the narrow gap arc extinguishing space formed between the partition walls, the flows of gas 1 and gas 2 evaporated from the outer partition walls 7*a*, 7*b* are generated to push the arc 1 and arc 2 developed between the fixed and movable contacts towards the central partition wall 7*c*. On the other hand, the repulsive electromagnetic force F (FIG. 11(*b*)) acts on the arc 1 and arc 2 developed between the fixed and movable contacts to separate each other, and is inversely proportional to the distance between the arcs. So, the cancellation takes place between the pushing force of the evaporated gas flows to the arcs and the repulsive electromagnetic force urging to separate the arcs. As a result, the beginning points of the arc 1 and the arc 2 stay at the center of the contact as shown in FIG. 7(*b*), thereby suppressing the abnormal or unbalanced dissipation of the contact as illustrated in FIG. 11(*c*).

The disclosure of Japanese Patent Applications No. 2006-318028 filed on Nov. 27, 2006 and 2006-067518 filed on Mar. 13, 2006 are incorporated as references.

While the invention has been explained with reference to the specific embodiments of the invention, the explanation is illustrative and the invention is limited only by the appended claims.

What is claimed is:

1. A circuit breaker for a doublebreak mechanism, comprising, a current interrupting section having a contact mechanism, said contact mechanism comprising first and second fixed contactors arranged in parallel and having fixed contacts, and a bridging movable contactor having an arm with movable contacts opposing the fixed contacts, and partition walls formed of organic polymer material and provided to stand along a path of switching movement of the movable contactor, said partition walls sandwiching each pair of the fixed contact and the movable contact to form a narrow arc extinguishing space between the partition walls, wherein said partition walls comprise outer partition walls formed outside the fixed contacts of the first and second fixed contactors and the movable contacts, and an inner partition wall situated between two pairs of the fixed contacts and the movable contacts, and the outer partition walls are composed of an organic polymer material that generates a greater amount of evaporating gas due to heat of arcing, and the inner partition wall is composed of an organic polymer material that generates an evaporating gas less than that formed by the outer partition walls.

2. A circuit beaker according to claim 1, wherein the outer partition walls have a thickness greater than that of the inner partition wall.

3. A circuit beaker for a double-break mechanism, comprising:

a current interrupting section having a contact mechanism, said contact mechanism comprising first and second fixed contactors arranged in parallel and having fixed contacts, and a bridging movable contactor having an arm with movable contacts opposing the fixed contacts, and partition walls formed of organic polymer material and provided to stand along a path of switching movement of the movable contactor, said partition walls sandwiching each pair of the fixed contact and the movable contact to form a narrow arc extinguishing space between the partition walls, wherein said partition walls comprise outer partition walls formed outside the fixed contacts of the first and second fixed contactors and the movable contacts, and an inner partition wall situated between two pairs of the fixed contacts and the movable contacts, and a distance between the pair of fixed and movable contacts and the outer partition wall is smaller than a distance between the pair of fixed and movable contacts and the inner partition wall provided.

* * * * *

UNITED STATES PATENT AND TRADEMARK OFFICE

CERTIFICATE OF CORRECTION

PATENT NO. : 7,541,901 B2
APPLICATION NO. : 11/712899
DATED : June 2, 2009
INVENTOR(S) : Masaaki Nakano et al.

It is certified that error appears in the above-identified patent and that said Letters Patent is hereby corrected as shown below:

Column 6, line 20, change "by the arrows in FIG. 4," to --by the arrows in FIG. 4.--, Column 8, line 15, "a doublebreak" to --a double-break--, Column 8, line 40, "A circuit beaker" to --A circuit breaker--, and Column 8, line 43, "A circuit beaker" to --A circuit breaker--.

Signed and Sealed this

Eleventh Day of August, 2009

David J. Kappos

David J. Kappos
*Director of the United States Patent and Trademark Office*